US006520441B2

(12) United States Patent
Rüskens et al.

(10) Patent No.: US 6,520,441 B2
(45) Date of Patent: Feb. 18, 2003

(54) WINDING DEVICE FOR A CHEESE-PRODUCING TEXTILE MACHINE

(75) Inventors: Herbert Rüskens, Wegberg (DE); Herbert Wellage, Hückelhoven (DE)

(73) Assignee: W. Schlafhorst AG & Co. (DE)

( * ) Notice: Subject to any disclaimer, the term of this patent is extended or adjusted under 35 U.S.C. 154(b) by 15 days.

(21) Appl. No.: 09/920,912

(22) Filed: Aug. 2, 2001

(65) Prior Publication Data

US 2002/0014548 A1 Feb. 7, 2002

(30) Foreign Application Priority Data

Aug. 3, 2000 (DE) ..... 100 37 833

(51) Int. Cl.[7] ..... B65H 57/00; B65H 54/00

(52) U.S. Cl. ..... 242/157 R; 242/470; 242/473.3; 242/481.2; 242/485.3; 242/485.8; 242/486.8

(58) Field of Search ..... 242/157 R, 485.3, 242/485.8, 481.7, 473.1, 473.3, 481.2, 486.8, 470

(56) References Cited

U.S. PATENT DOCUMENTS

| | | | | | |
|---|---|---|---|---|---|
| 158,427 | A | * | 1/1875 | Manchester et al. | 242/157 R |
| 367,966 | A | * | 8/1887 | Dobson | 242/485.3 |
| 829,886 | A | * | 8/1906 | McKean | 242/485.3 |
| 4,932,598 | A | * | 6/1990 | Stitz | 242/486.8 |
| 4,986,483 | A | * | 1/1991 | Ryu et al. | 242/470 |
| 4,993,650 | A | * | 2/1991 | Nickell | 242/481.7 |
| 5,004,170 | A | * | 4/1991 | Graf et al. | 242/470 |

FOREIGN PATENT DOCUMENTS

| | | |
|---|---|---|
| DE | OS 2 320 754 A1 | 11/1973 |
| DE | GM 81 09 036 | 8/1982 |
| DE | 35 13 796 C2 | 12/1985 |
| DE | 39 11 505 A1 | 10/1990 |
| DE | 41 31 179 A1 | 4/1993 |
| DE | 43 10 905 A1 | 10/1994 |
| DE | 43 30 647 A1 | 3/1995 |
| DE | 196 26 960 A1 | 1/1997 |
| DE | 196 32 748 A1 | 2/1997 |
| EP | 0 362 836 A1 | 4/1990 |

OTHER PUBLICATIONS

German Search Report.

* cited by examiner

*Primary Examiner*—Michael R. Mansen
(74) *Attorney, Agent, or Firm*—Kennedy Covington Lobdell & Hickman, LLP

(57) ABSTRACT

A winding device (1) for a textile machine producing cheeses (8), having a cheese drive mechanism (5) acting on a tube receiving plate (6), a separately driveable yam cross-winding device (10), and a support and clamping roller (9), in frictional contact with the cheese (8) during winding operation. A braking device (20) is assigned for braking the support and clamping roller (9) when the winding operation is interrupted.

5 Claims, 4 Drawing Sheets

WINDING DEVICE FOR A CHEESE-PRODUCING TEXTILE MACHINE

CROSS-REFERENCES TO RELATED APPLICATIONS

This application claims the benefit of German patent application DE P 10037833.1, filed Aug. 3, 2000, herein incorporated by reference.

FIELD OF THE INVENTION

The present invention relates generally to a winding device for a cheese-producing textile machine, and, more particularly, to such a winding device having a cheese drive mechanism acting on a tube receiving plate, a separately driveable yarn cross-winding device, and a support and clamping roller which is in frictional contact with the cheese during the winding operation.

BACKGROUND OF THE INVENTION

A winding device of the basic type described above is disclosed, for example, in German Patent Publication DE 43 10 905 A1. In this known device, the cheese is directly driven, i.e. one of the tube receiving plates rotatably seated on the arms of the creel is connected with a speed (rpm) controlled drive mechanism. During the winding process, the cheese rests on a relatively light support and clamping roller, which is driven in turn by its frictional contact with the cheese. Such a device makes it possible to minimize the loss of lift occurring in the course of the cross-winding of the yarn, wherein the kinetic energy to be transmitted between the cheese and the support and clamping roller is relatively small. A similar winding device is also described in German Patent Publication DE 43 30 647 A1. In this winding device also, the surface of a directly driven cheese rests on a stationary, freely rotatably seated support and clamping roller of this device.

However, these known winding devices have the disadvantage that the support and clamping roller continues to run uncontrolled for a certain amount of time when the cheese is lifted off the support and clamping roller and braked to a stop, for example in case of a yarn break or of a controlled yarn cut. This continued uncontrolled running of the support and clamping roller always presents the danger that the bottom thread is grasped by the support and clamping roller and an undesired series of yam wrappings are then formed thereabout.

SUMMARY OF THE INVENTION

In view of the above mentioned known devices, it is an object of the invention to create a winding device with an improved support and clamping roller.

In accordance with the invention, this object is attained by a winding device having a support and clamping roller with its own braking device, which offers the particular advantage that the continued running of the support and clamping roller, which heretofore was customary and often injurious to the continued winding process, is immediately and effectively interrupted when the cheese is lifted off the support and clamping roller.

In a preferred embodiment, the braking device is embodied in such a way that, when the cheese is raised, the support and clamping roller is automatically braked to a stop by being placed on the braking device, without additional sensor and/or control means being required.

A particularly advantageous embodiment results by mounting the support and clamping roller to be movably seated in association with a biasing spring operative to push against a braking element of the braking device when the contact pressure of the cheese is no longer present. It is also preferred that the support and clamping roller is seated for free rotation on bearing arms which are respectively connected to stationary bearing brackets via a pivot shaft. Spring elements act on the bearing arms in the direction toward the braking device. Such an embodiment is not only quite cost-effective in its manufacture, but is also operable almost free of maintenance. Moreover, this embodiment is extremely functionally reliable, i.e. the support and clamping roller is almost instantaneously braked to a stop, independent of the rotational velocity, after the cheese has been raised.

It is further preferred to arrange a braking element on at least one of the stationary bearing brackets in a disposition for easily replaceability. The arrangement of the braking element on the side opposite the yam cross-over device is particularly advantageous, because in this case the direction of rotation of the support and clamping roller assists the contact pressure of the spring element, which has a very positive effect on the braking action.

Further details, features and advantages of the present invention will be described and understood from an exemplary embodiment disclosed hereinbelow with reference to the accompanying drawings.

DETAILED DESCRIPTION OF THE PREFERRED EMBODIMENT

Figure 1:
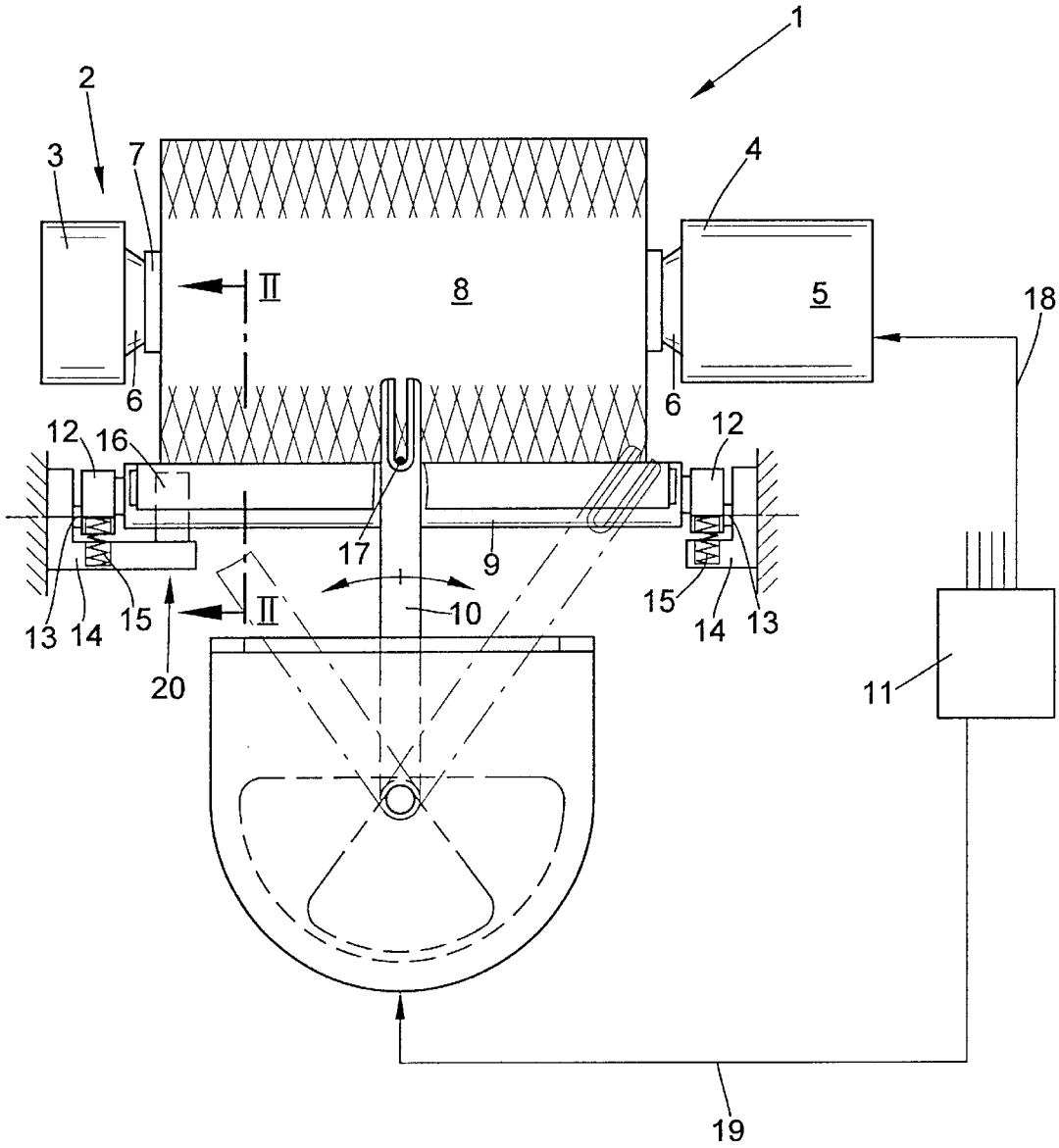
FIG. 1 is a front elevational view of a winding device in accordance with the present invention, shown during the winding process with the cheese resting on the support and clamping roller.
Figure 2:
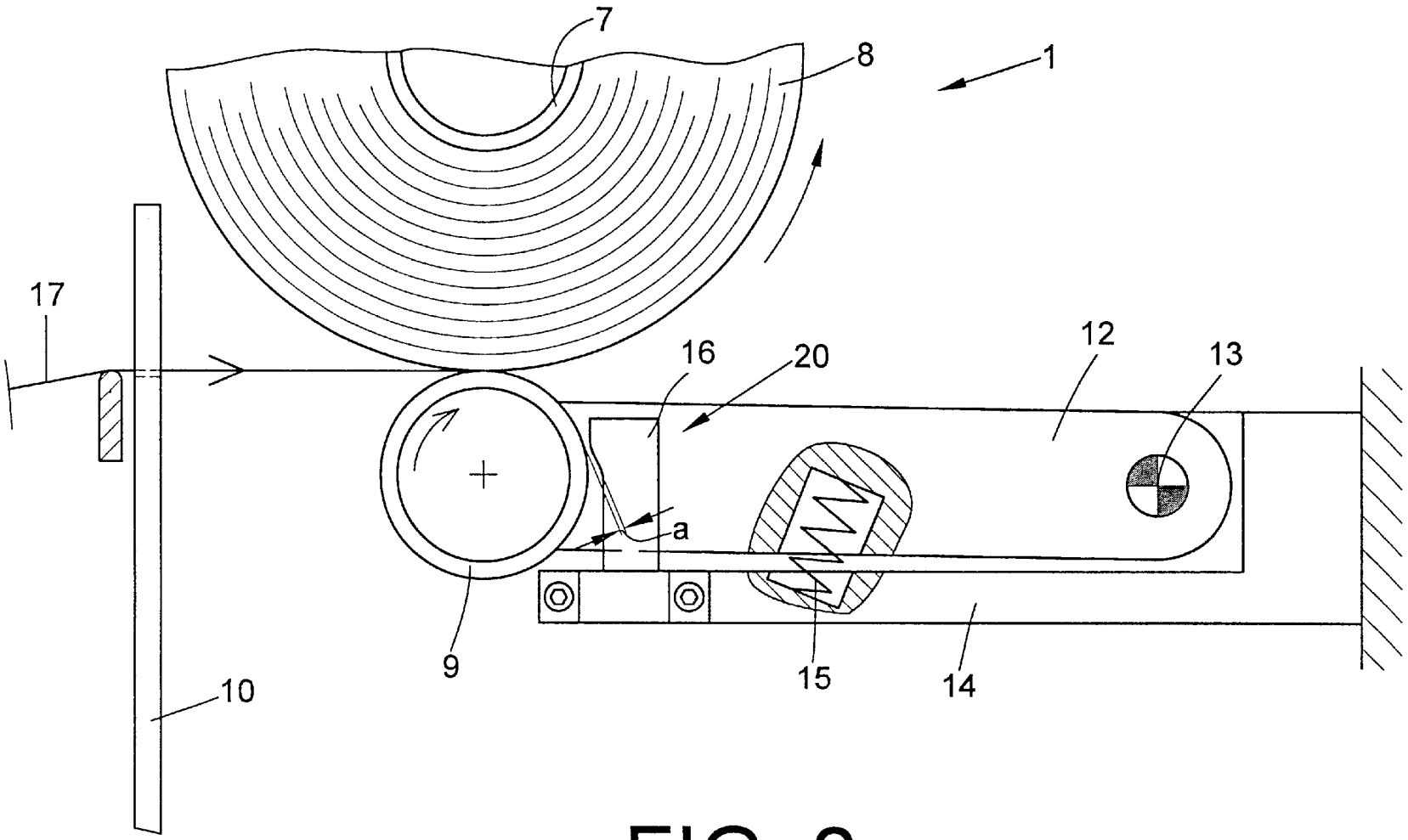
FIG. 2 is a side elevational view, partially in section, of the winding device in accordance with FIG. 1.

Referring now to the accompanying drawings and initially to FIGS. 1 and 2, a winding device according to the present invention is indicated in the drawing figures at 1 and essentially comprises a creel 2, only schematically represented, having a creel arm 4 with an integrated cheese drive mechanism 5, a support and clamping roller 9, and a yarn cross-over device 10.

A cheese 8 is supported by means of tube receiving plates 6 between the winding arms 3 and 4 of the creel 2. As shown particularly in FIGS. 1 and 3, the tube receiving plates 6 act on a cheese tube 7 in a customary manner. One of the tube receiving plates 6 is connected with the cheese drive mechanism 5 which is connected to a control device, preferably a winding station computer 11, via a control line 18. In like manner, the drive mechanism for the yarn cross-over device 10 is connected to the winding station computer 11 or other control device via a control line 19.

Figure 4:
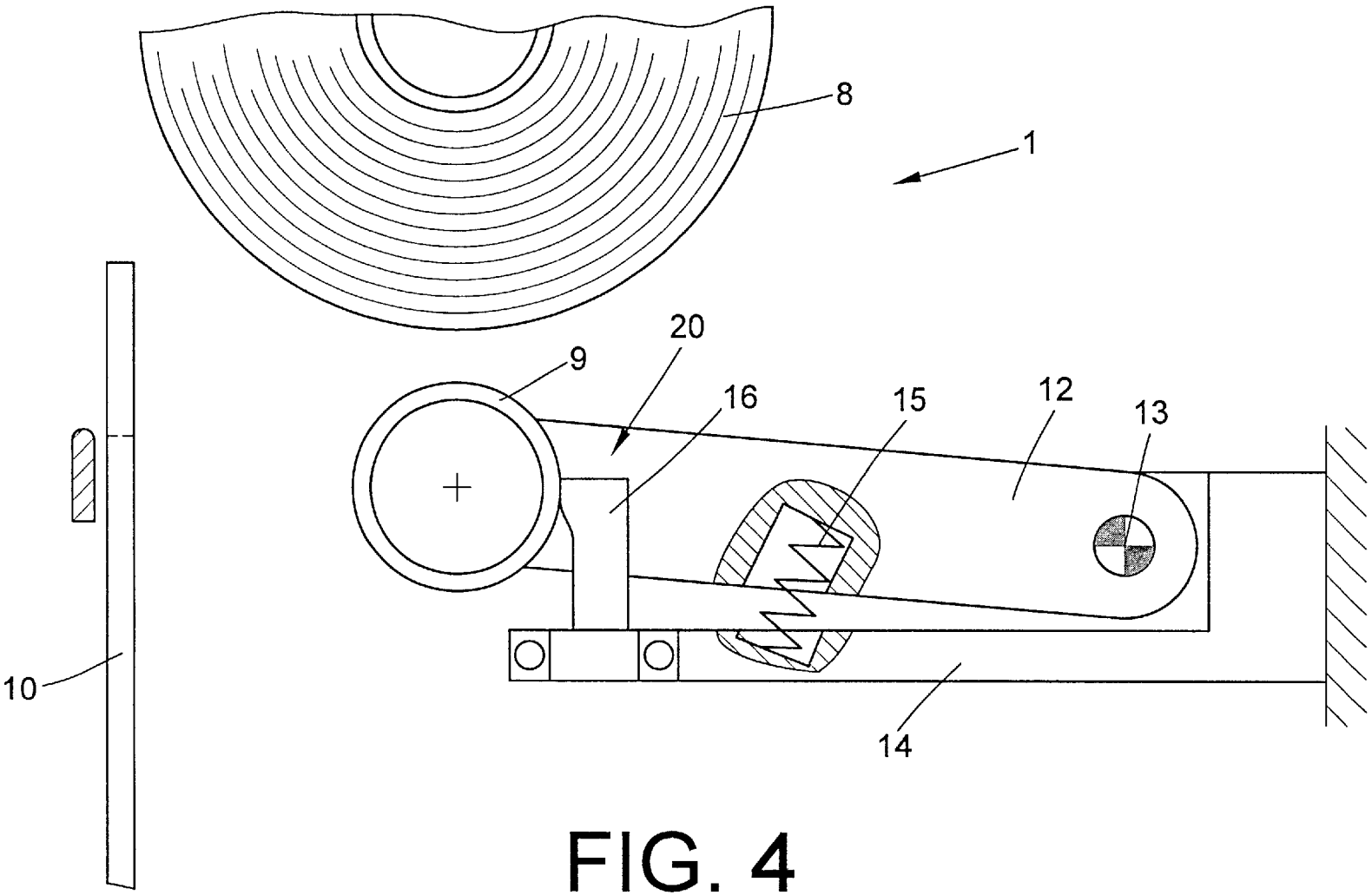
FIG. 4 is another side elevational view, partially in section, showing the winding device during an interruption of the winding process in accordance with FIG. 3.

The support and clamping roller 9 is fixed in place, freely rotatable on pivotably seated bearing arms 12, each of which, in turn, is itself connected via pivot shafts 13 with stationary bearing brackets 14. As indicated in FIGS. 2 and 4, a spring element, preferably designed as a compression spring 15, is disposed between each of the pivotably movable bearing arms 12 and the stationary bearing brackets 14.

Furthermore, a braking device 20 in accordance with the present invention is installed on at least one of the bearing brackets 14. Preferably, this braking device 20 has a braking element 16, which is replaceable, for example, and is arranged in such a way that, as indicated in FIG. 2, a distance a is provided between the support and clamping roller 9 and the braking element 16 during the winding process.

Figure 3:
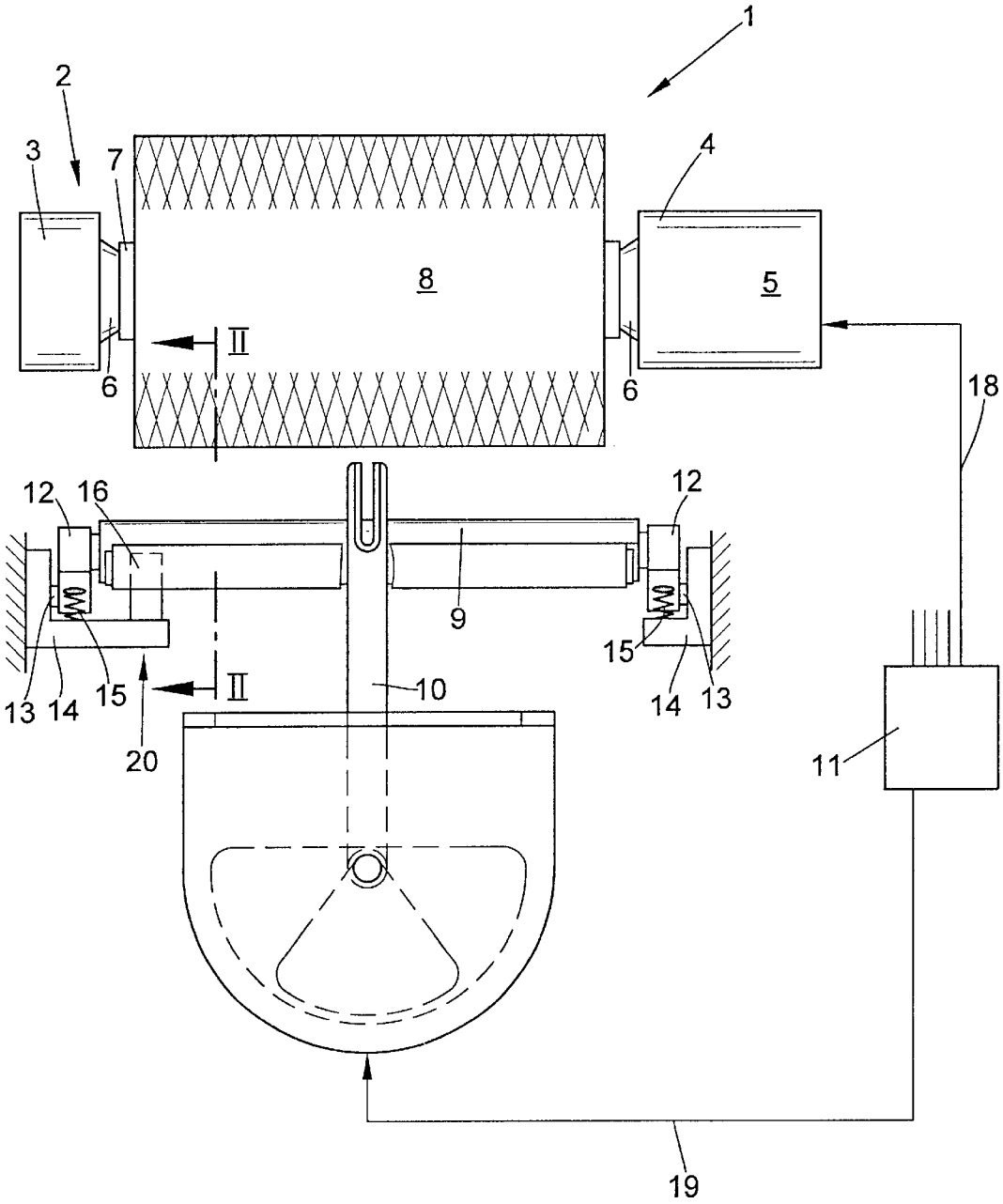
FIG. 3 is another front elevational view of the winding device in accordance with FIG. 1, shown during an interruption of the winding process with the cheese raised and the support and clamping device being acted on by the braking device in accordance with the present invention.

The operation of the present device may thus be understood. If a winding interruption occurs at the respective winding device, either because the yarn 17 breaks, or a controlled cleaning cut is performed because of a detected yarn defect, the creel 2 is immediately pivoted slightly toward the top and the cheese 8 is braked to a stop by means of a braking device, not represented in the drawings, which is integrated into the cheese drive mechanism 5. At the same time, pivoting of the creel 2 results in lifting of the cheese 8 off the support and clamping roller 9, as indicated in FIGS. 3 and 4.

In the course of lifting the cheese 9 off the support and clamping roller 9, the latter is simultaneously pivoted around the pivot shaft 13 by the action of the spring elements 15, and the support and clamping roller 9 comes to rest against the braking element 16 of the stationary braking device 20. This contact of the support and clamping roller 9 with the braking element 16 of the stationary braking device 20 results in an almost instantaneous braking of the relatively light support and clamping roller 9.

As will be readily understood, the invention is not intended to be limited to the exemplary embodiment represented. Further, alternative embodiments are easily conceivable within the scope of the general idea of the invention. For example, a stationary braking device 20 can be provided at each one of the stationary bearing brackets 14, or the braking device(s) may be positioned, looking in the viewing direction above rather than behind the support and clamping roller.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn winding device for a cheese-producing textile machine, comprising a cheese drive mechanism acting on a tube receiving plate which supports a tube for winding of a yarn cheese thereon, a separately driveable yarn cross-winding device, a support and clamping roller disposed for frictional contact with the cheese during a winding operation, and a braking device associated with the support and clamping roller for braking thereof, the tube receiving plate being movable to separate the cheese from the support and clamping roller when winding operation is interrupted and the braking device being arranged for automatically braking the support and clamping roller to a stop when the cheese is separated from the support and clamping roller, the support and clamping roller being arranged for movement, in the absence of frictional contact with the cheese, into engagement with a braking element of the braking device.

2. The winding device in accordance with claim 1, characterized in that the support and clamping roller is freely rotatable between bearing arms, each of which is connected via a pivot shaft to a stationary bearing bracket and acted upon by a spring element.

3. The winding device in accordance with claim 1, characterized in that the braking element is arranged stationarily on at least one of the bearing brackets.

4. The winding device in accordance with claim 3, characterized in that the braking element is replaceably fixed on the one bearing bracket.

5. The winding device in accordance with claim 1, characterized in that the braking element is arranged on a side of the support and clamping roller opposite the yam cross-over device.

* * * * *